US009150342B2

(12) United States Patent
Sierra-Gomez et al.

(10) Patent No.: US 9,150,342 B2
(45) Date of Patent: Oct. 6, 2015

(54) RESEALABLE TRAY CONTAINER

(75) Inventors: Gladys Odette Sierra-Gomez, Woodbridge, NJ (US); Eva Marie Peters, Cedar Grove, NJ (US); Alexis Julian Gracia-Lugo, Bloomingdale, NJ (US); Paul Anthony Mankowski, Maplewood, NJ (US); Douglas Philipsen, Great Meadows, NJ (US); Daniel Robert Feldmeier, Waunakee, WI (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 1015 days.

(21) Appl. No.: 11/193,613

(22) Filed: Aug. 1, 2005

(65) Prior Publication Data

US 2007/0023435 A1 Feb. 1, 2007
US 2010/0230411 A9 Sep. 16, 2010

Related U.S. Application Data

(63) Continuation-in-part of application No. 11/029,651, filed on Jan. 6, 2005, now Pat. No. 7,344,744, which is a continuation-in-part of application No. 10/414,502, filed on Apr. 16, 2003, now Pat. No. 6,918,532.

(51) Int. Cl.
*B65D 77/20* (2006.01)

(52) U.S. Cl.
CPC ..... *B65D 77/206* (2013.01); *B65D 77/2096* (2013.01)

(58) Field of Classification Search
CPC ..... B65D 77/206; B65D 77/2096
USPC ..... 229/87.08, 123.1; 220/359.2, 258.2, 220/4.24, 359.1, 359.3–359.5; 426/115, 426/106; 53/410; 206/557–565
See application file for complete search history.

(56) References Cited

U.S. PATENT DOCUMENTS 811,092 A 1/1906 Roberts
1,065,012 A 6/1913 Watanabe
(Continued)

FOREIGN PATENT DOCUMENTS

AU 768679 12/2003
BR 55008852 11/2001
(Continued)

OTHER PUBLICATIONS

*Reseal-it*. [Homepage of Macfarlane Group] [Online] 2005. Available from: http://www.reseal-it.se [Accessed Mar. 14, 2005].
(Continued)

*Primary Examiner* — Bryon Gehman
(74) *Attorney, Agent, or Firm* — Fitch, Even, Tabin & Flannery LLP

(57) ABSTRACT

A container for food product includes a film affixed to a food tray. The film forms a top of the container and has an access opening. The sealing label, adhesively sealed to the top around the opening, is resealable when a tab of the sealing label is pulled back. The sealing label is resealable against the top layer to seal the opening when the label is moved back against the top. In one form, the sealing label extends along the top of the container and seals along a portion of the film which is affixed to one or more top end surfaces of walls forming the tray.

40 Claims, 6 Drawing Sheets

(56) References Cited

U.S. PATENT DOCUMENTS 1,106,721 A 8/1914 Lewis
1,171,462 A 2/1916 Rice
1,791,352 A 2/1931 Pascual
1,949,161 A 2/1934 Haug
1,963,639 A 6/1934 Ahlquist
1,978,035 A 10/1934 Thom
2,033,550 A 3/1936 Rosen
2,066,495 A 1/1937 Swift
2,128,196 A 8/1938 Vogel
2,260,064 A 10/1941 Stokes
2,330,015 A 9/1943 Stokes
2,475,236 A 7/1949 Gollab
2,554,160 A 5/1951 Von Gunten
2,588,409 A 3/1952 Olsen
2,605,897 A 8/1952 Rundle
2,621,788 A 12/1952 Hitchcock
2,684,807 A 7/1954 Gerrish
2,823,795 A 2/1958 Moore
2,965,224 A 12/1960 Harwood
3,080,238 A 3/1963 Howard et al.
3,127,273 A 3/1964 Monoham
3,179,326 A 4/1965 Underwood et al.
3,186,628 A 6/1965 Rohde
3,187,982 A 6/1965 Underwood et al.
3,217,871 A 11/1965 Lee
3,235,165 A 2/1966 Jackson
3,245,525 A 4/1966 Shoemaker
3,259,303 A 7/1966 Repko
3,260,358 A 7/1966 Gottily et al.
3,272,422 A 9/1966 Miller
3,311,032 A 3/1967 Lucas
3,326,450 A 6/1967 Langdon
3,331,501 A 7/1967 Steward, Jr.
3,343,541 A 9/1967 Bellemy, Jr.
3,373,926 A 3/1968 Voightman, Sr. et al.
3,454,210 A 7/1969 Spiegel et al.
3,520,401 A 7/1970 Granowitz
3,528,825 A 9/1970 Doughty
3,570,751 A 3/1971 Trewella
3,595,466 A 7/1971 Rosenburg, Jr.
3,595,468 A 7/1971 Repko
3,618,751 A 11/1971 Rich
3,630,346 A 12/1971 Burnside
3,651,615 A 3/1972 Bohner et al.
3,653,502 A 4/1972 Beaudoin
3,687,352 A 8/1972 Kalajian
3,740,238 A 6/1973 Graham
3,757,078 A 9/1973 Conti et al.
3,790,744 A 2/1974 Bowen
3,811,564 A 5/1974 Braber
3,865,302 A 2/1975 Kane
3,885,727 A 5/1975 Gilley
3,905,646 A 9/1975 Brackmann et al.
3,909,582 A 9/1975 Bowen
3,910,410 A 10/1975 Shaw
3,938,659 A 2/1976 Wardwell
3,966,046 A 6/1976 Deutschlander
3,971,506 A 7/1976 Roenna
3,979,050 A 9/1976 Cilia
4,082,216 A 4/1978 Clarke
4,113,104 A 9/1978 Meyers
4,140,046 A 2/1979 Marbach
4,185,754 A * 1/1980 Julius ..... 221/63
4,192,420 A 3/1980 Worrell et al.
4,192,448 A 3/1980 Porth
4,258,876 A 3/1981 Ljungerantz
4,260,061 A 4/1981 Jacobs
4,273,815 A 6/1981 Gifford et al.
4,285,681 A 8/1981 Walitalo
4,306,367 A 12/1981 Otto
4,337,862 A 7/1982 Suter
4,364,478 A 12/1982 Tuns
4,397,415 A 8/1983 Lisiecki
4,411,365 A 10/1983 Horikawa et al.
4,420,080 A * 12/1983 Nakamura ..... 206/449
4,428,477 A 1/1984 Cristofolo
4,464,154 A 8/1984 Ljungcrantz
4,488,647 A 12/1984 Davis
4,506,488 A 3/1985 Matt et al.
4,518,087 A 5/1985 Goglio
4,538,396 A 9/1985 Nakamura
4,545,844 A 10/1985 Buchanan
4,548,824 A 10/1985 Mitchell et al.
4,548,852 A 10/1985 Mitchell
4,549,063 A 10/1985 Ang et al.
4,550,831 A 11/1985 Whitford
4,552,269 A 11/1985 Chang
4,557,505 A 12/1985 Schaefer et al.
4,570,820 A 2/1986 Murphy
4,572,377 A 2/1986 Beckett
4,608,288 A 8/1986 Spindler
4,610,357 A 9/1986 Nakamura
4,613,046 A 9/1986 Kuchenbecker
4,616,470 A 10/1986 Nakamura
4,625,495 A 12/1986 Holovach
4,638,911 A 1/1987 Prohaska
4,648,509 A 3/1987 Alves
4,651,874 A 3/1987 Nakamura
4,653,250 A 3/1987 Nakamura
4,658,963 A 4/1987 Jud
4,667,453 A 5/1987 Goglio
4,671,453 A 6/1987 Cassidy
4,673,085 A 6/1987 Badouard et al.
4,679,693 A 7/1987 Forman
4,694,960 A 9/1987 Phipps et al.
4,696,404 A 9/1987 Corella
4,723,301 A 2/1988 Chang
4,738,365 A 4/1988 Prater
4,739,879 A 4/1988 Nakamura
4,784,885 A 11/1988 Carespodi
4,798,295 A 1/1989 Rausing
4,798,296 A 1/1989 Lagerstedt et al.
4,799,594 A 1/1989 Blackman
4,811,848 A 3/1989 Jud
4,818,120 A 4/1989 Addiego
4,838,429 A 6/1989 Fabisiewicz et al.
4,840,270 A 6/1989 Caputo et al.
4,845,470 A 7/1989 Boldt et al.
4,848,575 A 7/1989 Nakamura et al.
4,858,780 A * 8/1989 Odaka et al. ..... 220/359.2
4,863,064 A 9/1989 Dailey, III
4,865,198 A 9/1989 Butler
4,866,911 A 9/1989 Grindrod et al.
4,874,096 A 10/1989 Tessera-Chiesa
4,876,123 A 10/1989 Rivera et al.
4,889,731 A 12/1989 Williams
4,901,505 A 2/1990 Williams, Jr.
4,902,142 A 2/1990 Lammert et al.
4,917,247 A 4/1990 Jud
4,943,439 A 7/1990 Andreas et al.
4,972,953 A 11/1990 Friedman et al.
4,998,666 A 3/1991 Ewan
4,999,081 A 3/1991 Buchanan
5,001,325 A 3/1991 Huizinga
5,005,264 A 4/1991 Breen
5,010,231 A 4/1991 Huizinga
5,018,625 A 5/1991 Focke et al.
5,029,712 A 7/1991 O'Brien
5,040,685 A 8/1991 Focke et al.
5,046,621 A 9/1991 Bell
5,048,718 A 9/1991 Nakamura
5,060,848 A 10/1991 Ewan
5,065,868 A 11/1991 Cornelissen et al.
5,077,064 A 12/1991 Hustad et al.
5,078,509 A 1/1992 Center et al.
5,082,702 A 1/1992 Alband
5,085,724 A 2/1992 Focke
5,096,113 A 3/1992 Focke
5,100,003 A 3/1992 Jud
5,103,980 A 4/1992 Kuchenbecker
5,108,669 A 4/1992 vanDijk
5,124,388 A 6/1992 Pruett et al.
5,125,211 A 6/1992 O'Brien et al.
5,134,001 A 7/1992 Osgood

(56) References Cited

U.S. PATENT DOCUMENTS 5,158,499 A 10/1992 Guckenberger
5,161,350 A 11/1992 Nakamura
5,167,974 A 12/1992 Grindrod et al.
5,174,659 A 12/1992 Laske
5,184,771 A 2/1993 Jud et al.
5,197,618 A 3/1993 Goth
5,222,422 A 6/1993 Benner, Jr. et al.
5,222,813 A 6/1993 Kopp et al.
5,229,180 A 7/1993 Littmann
5,294,470 A 3/1994 Ewan
5,307,988 A 5/1994 Focke et al.
5,333,735 A 8/1994 Focke et al.
5,344,007 A * 9/1994 Nakamura et al. ..... 206/205
5,352,466 A 10/1994 Delonis
5,356,068 A 10/1994 Moreno
5,366,087 A 11/1994 Bane
5,371,997 A 12/1994 Kopp et al.
5,374,179 A 12/1994 Swanson
5,375,698 A 12/1994 Ewart et al.
5,381,643 A 1/1995 Kazaitis et al.
5,382,190 A 1/1995 Graves
5,405,629 A 4/1995 Marnocha et al.
5,407,070 A 4/1995 Bascos et al.
5,409,115 A 4/1995 Barkhorn
5,409,116 A 4/1995 Aronsen
5,454,207 A 10/1995 Storandt
5,460,838 A 10/1995 Wermund
5,460,844 A 10/1995 Gaylor
5,461,845 A 10/1995 Yeager
5,464,092 A 11/1995 Seeley
5,470,015 A 11/1995 Jud
5,489,060 A 2/1996 Godard
5,499,757 A 3/1996 Back
5,503,858 A 4/1996 Reskow
5,505,305 A 4/1996 Scholz et al.
5,515,965 A 5/1996 Boldrini et al.
5,519,982 A 5/1996 Herber et al.
5,520,939 A 5/1996 Wells
5,524,759 A 6/1996 Herzberg et al.
5,531,325 A 7/1996 Delflander et al.
5,538,129 A 7/1996 Chester et al.
5,550,346 A 8/1996 Andriash et al.
5,558,438 A 9/1996 Warr
5,582,342 A 12/1996 Jud
5,582,853 A 12/1996 Marnocha et al.
5,582,887 A 12/1996 Etherefge
5,591,468 A 1/1997 Stockley, III et al.
5,630,308 A 5/1997 Guckenberger
5,633,058 A 5/1997 Hoffer et al.
5,637,369 A 6/1997 Stewart
5,647,100 A 7/1997 Porchia et al.
5,647,506 A 7/1997 Julius
5,664,677 A 9/1997 O'Connor
5,688,394 A 11/1997 McBridge, Jr. et al.
5,688,463 A 11/1997 Robichaud et al.
5,702,743 A 12/1997 Wells
5,709,479 A 1/1998 Bell
5,725,311 A 3/1998 Ponsi et al.
D394,605 S 5/1998 Skiba et al.
5,749,657 A 5/1998 May
5,770,283 A 6/1998 Gosselin et al.
5,795,604 A 8/1998 Wells et al.
5,819,931 A 10/1998 Boucher
5,820,953 A 10/1998 Beer et al.
5,833,368 A 11/1998 Kaufman
5,855,435 A 1/1999 Chiesa
5,862,101 A 1/1999 Haas et al.
5,873,483 A 2/1999 Görtz et al.
5,873,607 A 2/1999 Waggoner
5,882,116 A 3/1999 Backus
5,885,673 A 3/1999 Light et al.
5,906,278 A 5/1999 Ponsi et al.
5,908,246 A 6/1999 Arimura
5,928,749 A 7/1999 Forman
5,938,013 A 8/1999 Palumbo et al.
5,939,156 A 8/1999 Rossi et al.
5,956,794 A 9/1999 Skiba et al.
5,993,962 A 11/1999 Timm et al.
5,996,797 A 12/1999 Flaig
5,997,177 A 12/1999 Kaufman
6,015,934 A 1/2000 Lee et al.
6,026,953 A 2/2000 Nakamura et al.
6,028,289 A 2/2000 Robichaud et al.
6,029,809 A 2/2000 Skiba et al.
6,056,141 A * 5/2000 Navarini et al. ..... 220/269
6,060,095 A 5/2000 Scrimager
6,065,591 A 5/2000 Dill et al.
6,066,437 A 5/2000 Kosslinger
6,076,969 A 6/2000 Jaisle et al.
6,077,551 A 6/2000 Scrimager
6,099,682 A 8/2000 Krampe et al.
6,113,271 A 9/2000 Scott et al.
6,125,614 A 10/2000 Jones et al.
6,126,009 A 10/2000 Shiffler et al.
6,126,317 A 10/2000 Anderson et al.
6,152,601 A 11/2000 Johnson
6,164,441 A 12/2000 Guy et al.
6,213,645 B1 4/2001 Beer
6,228,450 B1 5/2001 Pedrini
D447,054 S 8/2001 Hill
6,273,610 B1 8/2001 Koyama et al.
6,279,297 B1 8/2001 Latronico
6,296,884 B1 10/2001 Okerfund
6,299,355 B1 10/2001 Schneck
6,309,104 B1 10/2001 Koch et al.
6,309,105 B1 10/2001 Palumbo
6,318,894 B1 11/2001 Derenthal
6,352,364 B1 3/2002 Mobs
6,364,113 B1 4/2002 Faasse, Jr. et al.
6,365,255 B1 4/2002 Kittel et al.
6,383,592 B1 5/2002 Lowry et al.
6,402,379 B1 6/2002 Albright
6,420,006 B1 7/2002 Scott
6,427,420 B1 8/2002 Olivieri et al.
6,428,867 B1 * 8/2002 Scott et al. ..... 428/40.1
6,446,811 B1 9/2002 Wilfong, Jr.
6,450,685 B1 9/2002 Scott
6,457,585 B1 10/2002 Huffer et al.
6,461,043 B1 10/2002 Healy et al.
6,461,708 B1 10/2002 Dronzek
6,471,817 B1 10/2002 Emmert
6,476,743 B1 11/2002 Brown et al.
6,482,867 B1 11/2002 Kimura et al.
6,502,986 B1 1/2003 Bensur et al.
6,517,243 B2 2/2003 Huffer et al.
6,519,918 B2 2/2003 Forman et al.
6,539,691 B2 4/2003 Beer
6,554,134 B1 4/2003 Guibert
6,563,082 B2 5/2003 Terada et al.
6,589,622 B1 7/2003 Scott
6,592,260 B1 7/2003 Randall et al.
6,594,872 B2 7/2003 Cisek
6,612,432 B2 9/2003 Motson
6,616,334 B2 9/2003 Faaborg
6,621,046 B2 9/2003 Kaji
6,669,046 B1 12/2003 Sawada et al.
6,691,886 B1 2/2004 Berndt et al.
6,698,928 B2 3/2004 Miller
6,726,054 B2 4/2004 Fagen et al.
6,726,364 B2 4/2004 Perell et al.
6,746,743 B2 6/2004 Knoerzer et al.
6,750,423 B2 6/2004 Tanaka et al.
6,767,604 B2 7/2004 Muir, Jr. et al.
6,815,634 B2 11/2004 Sonoda et al.
6,852,947 B2 2/2005 Tanaka
6,865,860 B2 3/2005 Arakawa
6,889,483 B2 5/2005 Compton et al.
6,918,532 B2 7/2005 Sierra-Gomez et al.
6,929,400 B2 8/2005 Razeti et al.
6,951,999 B2 10/2005 Monforton et al.
6,983,875 B2 1/2006 Emmott
7,007,423 B2 3/2006 Andersson et al.
7,021,827 B2 4/2006 Compton et al.
7,032,757 B2 4/2006 Richards et al.

(56) References Cited

U.S. PATENT DOCUMENTS

| | | | |
|---|---|---|---|
| 7,032,810 | B2 | 4/2006 | Benedetti et al. |
| 7,040,810 | B2 | 5/2006 | Steele |
| 7,048,441 | B2 | 5/2006 | Pape |
| 7,051,877 | B2 | 5/2006 | Lin |
| 7,165,888 | B2 | 1/2007 | Rodick |
| 7,172,779 | B2 | 2/2007 | Castellanos et al. |
| 7,207,719 | B2 | 4/2007 | Marbler et al. |
| 7,213,710 | B2 | 5/2007 | Cotert |
| 7,228,968 | B1 | 6/2007 | Burgess |
| 7,254,873 | B2 | 8/2007 | Stolmeier et al. |
| 7,261,468 | B2 | 8/2007 | Schneider et al. |
| 7,262,335 | B2 | 8/2007 | Motsch et al. |
| 7,302,783 | B2 | 12/2007 | Cotert |
| 7,344,744 | B2 | 3/2008 | Sierra-Gomez et al. |
| 7,350,688 | B2 | 4/2008 | Sierra-Gomez et al. |
| 7,351,458 | B2 | 4/2008 | Leighton |
| 7,371,008 | B2 | 5/2008 | Bonenfant |
| 7,404,487 | B2 | 7/2008 | Kumakura et al. |
| 7,422,142 | B2 | 9/2008 | Arippol |
| 7,470,062 | B2 | 12/2008 | Moteki et al. |
| 7,475,781 | B2 | 1/2009 | Kobayashi et al. |
| 7,516,599 | B2 | 4/2009 | Doll et al. |
| 7,533,773 | B2 | 5/2009 | Aldridge et al. |
| 7,600,641 | B2 | 10/2009 | Burgess |
| 7,708,463 | B2 | 5/2010 | Sampaio Camacho |
| 7,717,620 | B2 | 5/2010 | Hebert et al. |
| 7,758,484 | B2 | 7/2010 | Peterson |
| 7,858,901 | B2 | 12/2010 | Krishnan et al. |
| 7,963,413 | B2 | 6/2011 | Sierra-Gomez et al. |
| 7,971,718 | B2 | 7/2011 | Aldridge |
| 8,002,941 | B2 | 8/2011 | Exner et al. |
| 8,029,428 | B2 | 10/2011 | Selle |
| 8,181,784 | B2 | 5/2012 | Bouthiette |
| 8,240,546 | B2 | 8/2012 | Friebe et al. |
| 2001/0000480 | A1 | 4/2001 | Stagg et al. |
| 2002/0068668 | A1 | 6/2002 | Chow et al. |
| 2003/0019780 | A1 | 1/2003 | Parodi et al. |
| 2003/0039412 | A1 | 2/2003 | Rodick |
| 2003/0047695 | A1 | 3/2003 | Zik et al. |
| 2003/0051440 | A1 | 3/2003 | Chow et al. |
| 2003/0118255 | A1 | 6/2003 | Miller |
| 2003/0127352 | A1 | 7/2003 | Buschkiel et al. |
| 2003/0170357 | A1 | 9/2003 | Garwood |
| 2003/0183637 | A1 | 10/2003 | Zappa et al. |
| 2003/0183643 | A1* | 10/2003 | Fagen et al. ..... 221/26 |
| 2003/0210838 | A1 | 11/2003 | Steele |
| 2003/0223656 | A1 | 12/2003 | Razeti et al. |
| 2004/0011677 | A1 | 1/2004 | Arakawa et al. |
| 2004/0035719 | A1 | 2/2004 | Ebbers et al. |
| 2004/0060974 | A1 | 4/2004 | Dacey |
| 2004/0067326 | A1 | 4/2004 | Knoerzer et al. |
| 2004/0083680 | A1 | 5/2004 | Compton et al. |
| 2004/0091184 | A1 | 5/2004 | Miller |
| 2004/0112010 | A1 | 6/2004 | Richards et al. |
| 2004/0150221 | A1 | 8/2004 | Brown |
| 2004/0175060 | A1 | 9/2004 | Woodham et al. |
| 2004/0180118 | A1 | 9/2004 | Renger et al. |
| 2004/0206637 | A1 | 10/2004 | Sierra-Gomez et al. |
| 2005/0031233 | A1 | 2/2005 | Varanese |
| 2005/0084186 | A1 | 4/2005 | Caris |
| 2005/0116016 | A1 | 6/2005 | Lo Duca |
| 2005/0117819 | A1 | 6/2005 | Kingsford et al. |
| 2005/0220371 | A1 | 10/2005 | Machacek |
| 2005/0247764 | A1 | 11/2005 | Sierra-Gomez et al. |
| 2005/0276525 | A1 | 12/2005 | Herbert |
| 2005/0276885 | A1 | 12/2005 | Bennett |
| 2005/0284776 | A1 | 12/2005 | Kobayashi |
| 2006/0018569 | A1 | 1/2006 | Bonenfant |
| 2006/0066096 | A1 | 3/2006 | Kan |
| 2006/0124494 | A1 | 6/2006 | Clark, Jr. et al. |
| 2006/0144911 | A1 | 7/2006 | Sierra-Gomez et al. |
| 2006/0171611 | A1 | 8/2006 | Rapparini |
| 2006/0199717 | A1 | 9/2006 | Marbler et al. |
| 2006/0251342 | A1 | 11/2006 | Forman |
| 2006/0257056 | A1 | 11/2006 | Miyake et al. |
| 2006/0257599 | A1 | 11/2006 | Exner |
| 2006/0285779 | A1 | 12/2006 | Golas |
| 2007/0023436 | A1 | 2/2007 | Sierra-Gomez et al. |
| 2007/0209959 | A1 | 9/2007 | Burgess |
| 2007/0275133 | A1 | 11/2007 | Sierra-Gomez et al. |
| 2008/0013869 | A1 | 1/2008 | Forman |
| 2008/0031555 | A1 | 2/2008 | Roberts |
| 2008/0037911 | A1 | 2/2008 | Cole et al. |
| 2008/0063759 | A1 | 3/2008 | Raymond et al. |
| 2008/0063760 | A1 | 3/2008 | Raymond et al. |
| 2008/0135428 | A1 | 6/2008 | Tallier |
| 2008/0152264 | A1 | 6/2008 | Pokusa et al. |
| 2008/0156861 | A1 | 7/2008 | Sierra-Gomez et al. |
| 2008/0159666 | A1 | 7/2008 | Exner et al. |
| 2008/0203141 | A1 | 8/2008 | Friebe |
| 2008/0214376 | A1 | 9/2008 | Bonenfant |
| 2008/0240627 | A1 | 10/2008 | Cole et al. |
| 2008/0273821 | A1 | 11/2008 | Doll |
| 2009/0001143 | A1 | 1/2009 | Cowan et al. |
| 2009/0028472 | A1 | 1/2009 | Andersson et al. |
| 2009/0161995 | A1 | 6/2009 | Henderson et al. |
| 2009/0211938 | A1 | 8/2009 | Aldridge |
| 2010/0018974 | A1 | 1/2010 | Lyzenga et al. |
| 2010/0113241 | A1 | 5/2010 | Herbert et al. |
| 2010/0278454 | A1 | 11/2010 | Huffer |
| 2010/0303391 | A9 | 12/2010 | Cole et al. |
| 2011/0127319 | A1 | 6/2011 | Golden |
| 2011/0132976 | A1 | 6/2011 | Drenowski |

FOREIGN PATENT DOCUMENTS

| | | | |
|---|---|---|---|
| BR | 62020307 | | 4/2003 |
| BR | 68046367 | | 10/2009 |
| CN | 1224396 | A | 7/1999 |
| CN | 1781819 | A | 6/2006 |
| DE | 1848870 | | 3/1962 |
| DE | 9003401 | | 5/1990 |
| DE | 9005297 | | 8/1990 |
| DE | 9014065 | | 4/1991 |
| DE | 4134567 | | 1/1993 |
| DE | 4241423 | | 6/1994 |
| DE | 19738411 | | 4/1999 |
| DE | 19822328 | | 11/1999 |
| DE | 202004012301 | | 12/2004 |
| DE | 202007005487 | | 6/2007 |
| DE | 102007030267 | A1 | 1/2009 |
| DE | 102010019867 | A1 | 9/2011 |
| EP | 0085289 | | 8/1983 |
| EP | 0307924 | A2 | 3/1989 |
| EP | 388310 | | 9/1990 |
| EP | 408831 | A1 | 1/1991 |
| EP | 0474981 | | 3/1992 |
| EP | 0488967 | | 6/1992 |
| EP | 0546369 | | 6/1993 |
| EP | 0447636 | | 3/1994 |
| EP | 0608909 | | 8/1994 |
| EP | 0613824 | | 9/1994 |
| EP | 0629561 | | 12/1994 |
| EP | 0661154 | | 7/1995 |
| EP | 0667828 | | 8/1995 |
| EP | 0669204 | | 8/1995 |
| EP | 0669204 | B2 | 8/1995 |
| EP | 0752375 | | 1/1997 |
| EP | 0796208 | | 9/1997 |
| EP | 0758993 | | 3/1998 |
| EP | 0905048 | | 3/1999 |
| EP | 0744357 | | 10/2000 |
| EP | 1046594 | | 10/2000 |
| EP | 1056066 | | 11/2000 |
| EP | 1136379 | | 9/2001 |
| EP | 1318081 | A1 | 6/2003 |
| EP | 1350741 | | 8/2003 |
| EP | 1375380 | | 1/2004 |
| EP | 1382543 | | 1/2004 |
| EP | 1437311 | | 7/2004 |
| EP | 1449789 | | 8/2004 |
| EP | 1457424 | | 9/2004 |
| EP | 1477425 | | 11/2004 |
| EP | 1488936 | | 12/2004 |

(56) References Cited

FOREIGN PATENT DOCUMENTS

| | | | |
|---|---|---|---|
| EP | 1086906 | | 5/2005 |
| EP | 1609737 | | 1/2006 |
| EP | 1619137 | | 1/2006 |
| EP | 1637472 | | 3/2006 |
| EP | 1697230 | | 9/2006 |
| EP | 1712468 | | 10/2006 |
| EP | 1755980 | | 2/2007 |
| EP | 1760006 | A1 | 3/2007 |
| EP | 1770025 | | 4/2007 |
| EP | 1608567 | | 7/2007 |
| EP | 1873082 | A1 | 1/2008 |
| EP | 1908696 | | 4/2008 |
| EP | 1939107 | | 7/2008 |
| EP | 1858776 | | 10/2008 |
| EP | 1975081 | | 10/2008 |
| EP | 1712488 | | 12/2008 |
| EP | 1846306 | | 3/2009 |
| EP | 2033910 | | 3/2009 |
| EP | 1468936 | | 10/2009 |
| EP | 2189506 | | 5/2010 |
| FR | 1327914 | | 4/1963 |
| FR | 2693988 | | 1/1994 |
| FR | 2674509 | | 2/1995 |
| FR | 2766794 | | 2/1999 |
| FR | 2783512 | | 3/2000 |
| GB | 2171077 | | 8/1986 |
| GB | 2266513 | | 11/1993 |
| GB | 2276095 | | 9/1994 |
| JP | 57163658 | | 10/1982 |
| JP | 60080405 | | 5/1985 |
| JP | 61060785 | | 10/1987 |
| JP | 63022370 | | 1/1988 |
| JP | 01167084 | A | 6/1989 |
| JP | 01226579 | A | 9/1989 |
| JP | 01267182 | A | 10/1989 |
| JP | H0581083 | | 11/1993 |
| JP | 09-156677 | | 6/1997 |
| JP | 09142551 | A | 6/1997 |
| JP | 9150872 | | 6/1997 |
| JP | 10059441 | | 3/1998 |
| JP | 10120016 | A1 | 5/1998 |
| JP | 10129685 | | 5/1998 |
| JP | 1998152179 | | 9/1998 |
| JP | 10120016 | | 12/1998 |
| JP | 11198977 | | 7/1999 |
| JP | 2000-335542 | | 12/2000 |
| JP | 2001114357 | | 4/2001 |
| JP | 2002002805 | A | 1/2002 |
| JP | 2002104550 | A | 4/2002 |
| JP | 200326224 | | 1/2003 |
| JP | 2003072774 | | 3/2003 |
| JP | 2005015015 | | 1/2005 |
| JP | 2006062712 | | 3/2006 |
| JP | 2007045434 | | 2/2007 |
| WO | 8606350 | | 11/1986 |
| WO | 9411270 | | 5/1994 |
| WO | 9411270 | A1 | 5/1994 |
| WO | 9532902 | | 12/1995 |
| WO | 9725200 | | 7/1997 |
| WO | 0064755 | | 11/2000 |
| WO | 0140073 | | 6/2001 |
| WO | 02064365 | | 8/2002 |
| WO | 02066341 | | 8/2002 |
| WO | 03013976 | | 2/2003 |
| WO | 03035504 | | 5/2003 |
| WO | 03037727 | | 5/2003 |
| WO | 03059776 | | 7/2003 |
| WO | 2004087527 | | 10/2004 |
| WO | 2005054079 | | 6/2005 |
| WO | 2005056420 | | 6/2005 |
| WO | 2005110042 | | 11/2005 |
| WO | 2005110865 | | 11/2005 |
| WO | 2005110876 | | 11/2005 |
| WO | 2005110885 | | 11/2005 |
| WO | 2005120989 | | 12/2005 |
| WO | 2005123535 | | 12/2005 |
| WO | 2006055128 | | 5/2006 |
| WO | 2006080405 | | 8/2006 |
| WO | 2006108614 | | 10/2006 |
| WO | 2007090419 | | 8/2007 |
| WO | 2008051813 | | 5/2008 |
| WO | 2008062159 | | 5/2008 |
| WO | 2008074060 | | 6/2008 |
| WO | 2008108969 | | 9/2008 |
| WO | 2008115693 | | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010051146 | A2 | 5/2010 |
| WO | 2010080810 | | 7/2010 |
| WO | 2010084336 | | 7/2010 |
| WO | 2010088492 | | 8/2010 |
| WO | 2010114879 | | 10/2010 |
| WO | 2010149996 | | 12/2010 |
| WO | 2011004156 | | 1/2011 |
| WO | 2011121337 | | 10/2011 |

OTHER PUBLICATIONS

Patent Abstracts of Japan, vol. 1997 No. 10, Oct. 31, 1997 & JP09156677 A (Fuji Seal Col Ltd.), (Jul. 6, 1997) abstract in English and 7 figures.
"Elite Edam Cheese", Mintel gnpd, Dec. 3, 2001, Mintel Publishing.
"New Easy Peel Cheese Packaging", Mintel gnpd, Aug. 10, 2001, Mintel Publishing.
"Cheese Range", Mintel gnpd, Jan. 26, 2001, Mintel Publishing.
"Soft Bread Sticks", Mintel gnpd, Mar. 20, 1998, Mintel Publishing.
"New on the Shelf—Product Instructions and Packaging Trends", Circle Reader Service Card No. 93, Aug. 1998, Baking & Snack.
Reclosure System Lengthens Food Life, Packaging News PPMA Preview, Sep. 2001, p. 40.
Machinery Update, Mar./Apr. 2002, pp. 59-60.
Giant Baby Wipes package, item No. 80203-91, resealable packing having die cut-out portions (tabs) which remain affixed to the top of the package after label is withdrawn from the top, whereby tamper evidence is indicated by a misalignment of the die cut-out portions with the holes formed in the label.
"Margin." Merriam-Webster Online Dictionary, 2010. Merriam-Webster (online), retrieved on May 6, 2010. Retrieved from internet www.merriam-webster.com/dictionary/margin; 3 pgs.
English Translation of JP 1998-152179 published Sep. 6, 1998; 6 pgs.
English Translation of JP 2001-114357 published Apr. 24, 2001; 8 pgs.
English Translation of JP 2003-26224 published Jan. 29, 2003; 13 pgs.
English Translation of JP H09-156677 published Jun. 17, 1995; 8 pgs.
English Translation of JP Official Notice of Rejection mailed Feb. 14, 2012 in JP Application No. 2009-172352; 3 pgs.
English Translation of JP S60-80405 published Aug. 5, 1985; 21 pgs.
European Packaging Pack Report, NR. May 5, 2001 and partial translation thereof, 6 pgs.
Fuji Packaging GmbH Fachpack brochure, Oct. 11-12, 2001; 2 pgs.
Machinery Update, Sep./Oct. 2001; pp. 46-47; 4 pgs.
Opposition to EP 1679269 filed by Awapatent AB, Helsingborg, Sweden, May 2, 2012; 26 pgs.
Opposition to EP 1679269 filed by Bahlsen GmbH and Co., KG, Apr. 30, 2012; 15 pgs.
Select portions of prosecution history of U.S. Appl. No. 11/029,651.
Select portions of prosecution history of U.S. Appl. No. 11/098,872.
Reseal it Webpage. Internet Printout (accessed Mar. 14, 2005).
Select portions of prosecution history of U.S. Appl. No. 12/556,292.
Select portions of prosecution history of U.S. Appl. No. 10/414,502.
Select portions of prosecution history of U.S. Appl. No. 10/897,712.
Select portions of prosecution history of U.S. Appl. No. 11/193,614.
Select portions of prosecution history of U.S. Appl. No. 11/029,626.
Select portions of prosecution history of U.S. Appl. No. 12/118,935.

(56) References Cited

OTHER PUBLICATIONS

Select portions of prosecution history of U.S. Appl. No. 11/438,705.
Select portions of prosecution history of U.S. Appl. No. 11/500,497.
Select portions of prosecution history of U.S. Appl. No. 11/616,386.
Select portions of prosecution history of U.S. Appl. No. 11/693,751.
Select portions of prosecution history of U.S. Appl. No. 12/179,103.
"Wall's Bacon—A Sizzling Success Story" and The Grocer: "When sealed delivers", The second page of which bears a date of Aug. 21, 1999.
Defendants' Answer, Affirmative Defenses, and Counterclaims Responsive to Complaint, dated Apr. 5, 2012, 25 pages.
Defendants' Initial Non-Infringement Contentions Pursuant to LPR 2.3(a), dated May 17, 2013, 7 pages.
Defendants' Invalidity Contentions—Exhibit A-1, dated May 17, 2013, 55 pages.
Defendants' Invalidity Contentions—Exhibit A-2, dated May 17, 2013, 35 pages.
Defendants' Invalidity Contentions—Exhibit A-3, dated May 17, 2013, 34 pages.
Defendants' Invalidity Contentions—Exhibit A-4, dated May 17, 2013, 35 pages.
Defendants' invalidity Contentions—Exhibit A-5, dated May 17, 2013, 39 pages.
Defendants' Invalidity Contentions Pursuant to LPR 2.3, dated May 17, 2013, 23 pages.
Defendants' LPR 2.3 Initial Non-Infringement Contentions Exhibit A, dated May 17, 2013, 39 pages.
Defendants' Unenforceability Contentions Pursuant to LPR 2.3, dated May 17, 2013, 13 pages.
English Translation of JP Official Notice of Rejection mailed on Jan. 29, 2013 in JP Appl. No. 2008-087152 citing JPH0581083, 5 pages.
European Search Report, EP10305289 citing DE1848870U, 3 pages.
Global Brands' LPR 2.5 Initial Response to Defendants' Initial Invalidity Contentions Chart Ex. A-1, dated May 31, 2013, 30 pages.
Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-5, dated May 31, 2013, 14 pages.
Global Brands LPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Machine translation of DE 202007005487, published Jun. 14, 2007, provided by Espacenet, 3 pages.
Partial European Search Report for Appl. No. EP11155570 dated Jun. 12, 2011, citing DE9003401 and DE9005297, 9 pages.
Plaintiff's Initial Response to Defendant's Initial Invalidity Contentions, dated May 31, 2013, 20 pages.
Plaintiffs Answer to Counterclaims of Defendant, dated Apr. 26, 2013, 20 pages.
Plaintiffs Complaint for Patent Infringement, dated Jan. 16, 2013, 7 pages.
Machine translation of CN 1781819A published Jun. 7, 2006 from google.com/patents; 13 pages, accessed Jun. 5, 2014.
English Translation of Japanese Unexamined Application Publication No. H9-156677, published Jul. 17, 1997; 6 pages.
Kellogg's Reply Claim Construction Brief, dated Jan. 24, 2014, 19 pages.
Kellogg's Opening Claim Construction Brief, dated Dec. 13, 2013, 92 pages.
Defendants' Supplemental Memorandum of Law Regarding Additional Claim Construction Authority Requested by the Court, dated Feb. 28, 2014, 21 pages.
Kellogg's Response to Plaintiffs Surreply Claim Construction Brief Pursuant to Docket No. 98, dated Feb. 28, 2014, 12 pages.
Plaintiff Intercontinental Great Brands LLC's Submission of Authority Pursuant to Docket No. 98, dated Feb. 28, 2014, 11 pages.
Plaintiff Intercontinental Great Brands LLC's Responsive Claim Construction Brief Pursuant to LPR 4.2, dated Feb. 10, 2014, 121 pages.
U.S. District Court for the Northern District of Illinois, Eastern Division Memorandum Opinion and Order, dated Sep. 22, 2014, 12 pages.
Plaintiff Intercontinental Great Brands LLC\s Surreply Claim Construction Brief Pursuant to Docket No. 98, dated Feb. 21, 2014, 6 pages.
Defendants' Motion for Summary Judgment of Non-Infringement and Motion for Summary Judgment of Invalidity Under 35 U.S.C. 102 And/Or 103, dated Mar. 23, 2015, 4 pages.
Defendants' Consolidated Memorandum in Support of Motion for Summary Judgment (redacted) with Exhibits A-G, dated Mar. 23, 2015, 166 pages.
Defendants' Local Rule 56.1 Statement of Material Facts in Support of Motion for Summary Judgment (redacted), dated Mar. 23, 2015, 75 pages.
Declaration of James J. Lukas, Jr. in Support of Defendants' Motion for Summary Judgment with Exhibits, Part 1 dated Mar. 23, 2015, 277 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Exhibits, part 2, to Declaration of James J. Lukas, Jr. in Support of Defendants' Motion for Summary Judgment, dated Mar. 23, 2015 125 pages.
Exhibits, part 3, to Declaration of James J. Lukas, Jr. in Support of Defendants' Motion for Summary Judgment, dated Mar. 23, 2015, 125 pages.
Exhibits, part 4, to Declaration of James J. Lukas, Jr. in Support of Defendants' Motion for Summary Judgment with Exhibits, dated Mar. 23, 2015, 28 pages.
Defendants' Local Rule 56.1 Statement of Material Facts in Support of Motion for Summary Judgment, dated Mar. 23, 2015, 75 pages.
Additional Exhibits from Declaration of James Lukas Jr. filed Mar. 26, 2015, 73 pages.
Plaintiffs Cross-Motion for Summary Judgment, dated Apr. 27, 2015, 4 pages.
Plaintiffs Consolidated Memorandum of Law in Support of Plaintiff's Cross-Motion for Summary Judgment, dated May 8, 2015, 54 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Exhibits, part 2, to Declaration of Katie Crosby Lehmann in Support of Plaintiff's Consolidated Memorandum of Law in Support of Plaintiffs Cross-Motion for Summary Judgment (redacted), dated May 8, 2015, 300 pages.
Exhibits, part 3, to Declaration of Katie Crosby Lehmann in Support of Plaintiff's Consolidated Memorandum of Law in Support of Plaintiffs Cross-Motion for Summary Judgment (redacted), dated May 8, 2015, 100 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiffs Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted),dated May 8, 2015, 300 pages.
Exhibits, part 7, to Declaration of Katie Crosby Lehmann in Support of Plaintiff's Consolidated Memorandum of Law in Support of Plaintiffs Cross-Motion for Summary Judgment (redacted),dated May 8, 2015, 136 pages.

(56) References Cited

OTHER PUBLICATIONS

Defendants' Consolidated Reply in Support of Defendants' Motion for Summary Judgment with Exhibits, dated May 28, 2015, 36 pages.
Defendants' Response to Plaintiffs Local Rule 56.1 Statement of Material Facts in Support of Plaintiffs Motions for Summary Judgment, dated May 28, 2015, 108 pages.
Defendants' LR 56.1 (b) (3) (C) Statement of Additional Material Facts in Support of Their Opposition to Plaintiffs Motions for Summary Judgment (redacted), dated May 28, 2015, 30 pages.
Declaration of James J. Lukas, Jr. In Support of Defendants' Opposition to Plaintiffs Motions for Summary Judgment with Exhibits (redacted), dated May 28, 2015, 228 pages.
Plaintiffs Reply in Support of its Motions for Summary Judgment, dated Jun. 1, 2015, 19 pages.
Declaration of Katie Crosby Lehmann in Support of Plaintiff's Reply in Support of its Motions for Summary Judgment and Exhibit (unsealed), dated Jun. 10, 2015, 8 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.

* cited by examiner

RESEALABLE TRAY CONTAINER

RELATED APPLICATIONS

This application is a continuation-in-part of U.S. patent application Ser. No. 11/029,651, filed on Jan. 6, 2005, which issued as U.S. Pat. No. 7,344,744, which itself is a continuation-in-part of U.S. patent application Ser. No. 10/414,502, filed on Apr. 16, 2003, which issued as U.S. Pat. No. 6,918,532.

FIELD OF THE INVENTION

The present invention relates to a resealable tray and in particular to a new and improved resealable tray having a sealing label which can be pulled back and resealed against a top portion of the container.

BACKGROUND OF THE INVENTION

Containers for food products often come packaged in plastic trays. One conventional type includes a thermoformed tray. Several conventional lidding materials are available for covering conventional food trays. Lidding materials may be metal foil, flexible plastic wrap or rigid plastic.

One such package disclosed in U.S. Pat. No. 6,726,054 is designed for containing breath films or other oral care strips in which the package includes a blister pack having a hinged flap which is resealable against the top surface of the blister pack. The package has a top surface which forms a flange around the perimeter opening of the tray compartment. Another package which is disclosed in U.S. Pat. No. 6,691,886 shows a plastic tray with lid film which includes a sealing area around its perimeter which seals to a flange surface of the tray. U.S. Pat. No. 5,647,506 discloses another resealable container comprising a dispenser for moisture-impregnated articles such as moist tissues using a rigid plastic container with an opening formed in its top surface. A resealable label reseals the top opening.

In another prior dispensing package manufactured under the trade name RESEAL-IT, a thermoformed tray includes a lidding film affixed to an upper flange which encircles the opening of the tray. The lidding includes a die cut flap. A label larger than the flap opening is placed over the flap and spans completely across the lidding between but not onto the flange surfaces of the package. Thus, the label abuts the flange but does not extend onto the flange surface.

U.S. Pat. No. 4,156,493 discloses a reclosable dispenser packet. In one form, the packet includes a semi-rigid container which is thermo-formed or injection molded. A thin, flexible material such as vinyl film or aluminum foil is sealed to a flange of the container. An opening is cut into the flexible material. An adhesive flap is placed over the cut opening and seals with the container top so that the cut portion is permanently affixed to the adhesive flap as it is withdrawn from the top to expose the container opening.

There exists a need in the art for improved resealable containers suitable for containing food items.

BRIEF SUMMARY OF THE INVENTION

The present invention provides a new and improved container for food products. The food products may include but are not limited to discrete food items such as cookies, peanuts, cubed or shredded cheese, or other snack items; sliced meats such as cold cuts and bacon, both uncooked and ready-to-eat/ready-to-serve/pre-cooked, and sliced cheese; food spreads such as cream cheese and semi-solid foods such as chocolate dipping sauce and pudding. The container provides protection for the food contents while concurrently facilitating opening of the container and resealing the seal to protect the unused food contents thereof until the contents are fully consumed.

This purpose is achieved by providing a suitable tray for a desired food product in combination with an easily accessible opening seal formed in a top surface, which seal can reseal the container during use. The container can be of any shape including polygonal, such as square or rectangular, cylindrical or in the shape of a tub. The tray portion of the package may have sides which extend upwardly from the bottom of the tray and terminate at their ends or the sides which may include a flanges which extend either inwardly or outwardly relative to the interior of the tray.

In accordance with one embodiment, the present invention comprises a food container comprising a tray having a bottom and sides. The sides have a top end surface opposite the bottom. A film is affixed to the top end surface of the side and the film forms a top over the tray. A sealing layer is provided which has a sealing area adhesively sealing the sealing layer along its perimeter to the film around the opening. The sealing area terminates prior to reaching any side forming the tray. The sealing layer is releasable when the sealing layer is pulled in a direction away from the side to in turn pull and thereby release a portion of the sealing layer to provide access to the top access opening and resealable against the top to seal the opening when the sealing layer is moved back against the top.

In alternative further embodiments, the sealing layer includes a starter portion which can be grasped by a user and the starter portion may comprise a tab which extends from the sealing area of the sealing layer. The film may be composed of different materials which may be flexible, rigid or semi-rigid. In addition, the tray may be composed of either a rigid or semi-rigid material.

In accordance with another aspect of the present invention, a food container comprises a tray having a bottom and sides. The sides have a top end surface opposite the bottom. A food product is disposed in the tray. A film is affixed to the top end surface of the sides of the tray which forms a top over the tray. A sealing layer includes a sealing area adhesively sealing the sealing layer along its perimeter to the top around the opening and terminating prior to reaching any side forming the tray. The sealing layer is releasable when the sealing layer is pulled in a direction away from the side to in turn pull and thereby release at least a portion of the sealing layer to provide access to the top opening and resealable against the top to seal the opening when the sealing layer is moved back against the top.

In accordance with another aspect of the present invention, a food container comprises a tray having a bottom and sides. The sides have a top end surface opposite the bottom. A film is affixed to the sides, thereby forming a top over the tray. The top has an access opening to allow access to the contents inside the container. A sealing layer, having a sealing area, adhesively seals the sealing layer along its entire perimeter to the film around the access opening and extends along the film to overlap at least a portion of the film which is affixed to the top end surface of the side. The sealing layer is releasable when the sealing layer is pulled in a direction away from the side to, in turn pull, and thereby release a portion of the sealing layer to provide access to the access opening and is resealable against the top to seal the opening when the sealing layer is moved back against the top.

In alternative further embodiments, the sealing layer overlaps the film along at least a portion of the film at each side to which the film is affixed, and a starter portion comprises a tab extending from a corner of the sealing layer.

Thus, it is an object of the present invention to provide a new and improved resealable container comprising a tray with a film top.

These and other objects of the present invention will become apparent from the detailed description which follows.

BRIEF DESCRIPTION OF THE DRAWINGS

There follows a detailed description of preferred embodiments of the present invention, to be read together with the accompanying drawings, wherein.

DETAILED DESCRIPTION OF THE PREFERRED EMBODIMENTS

Figure 1:
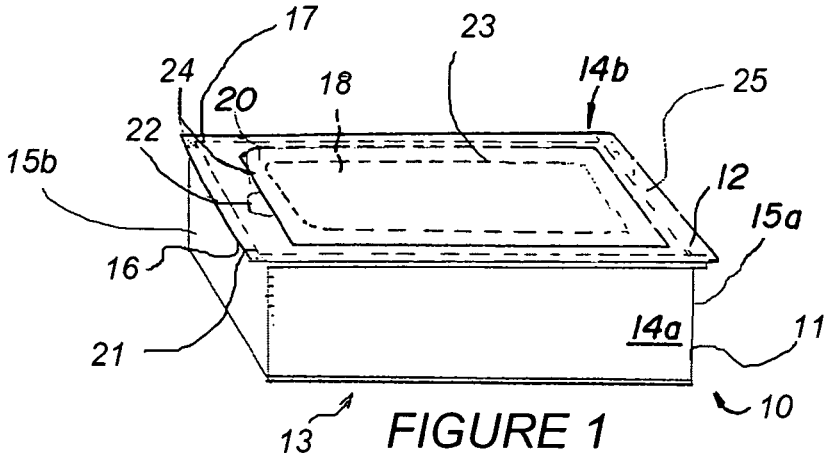
FIG. 1 is a perspective view of a resealable container in accordance with the present invention, in a closed configuration.

Referring to the drawings, like elements are represented by like numbers throughout the several views.

Figure 2:
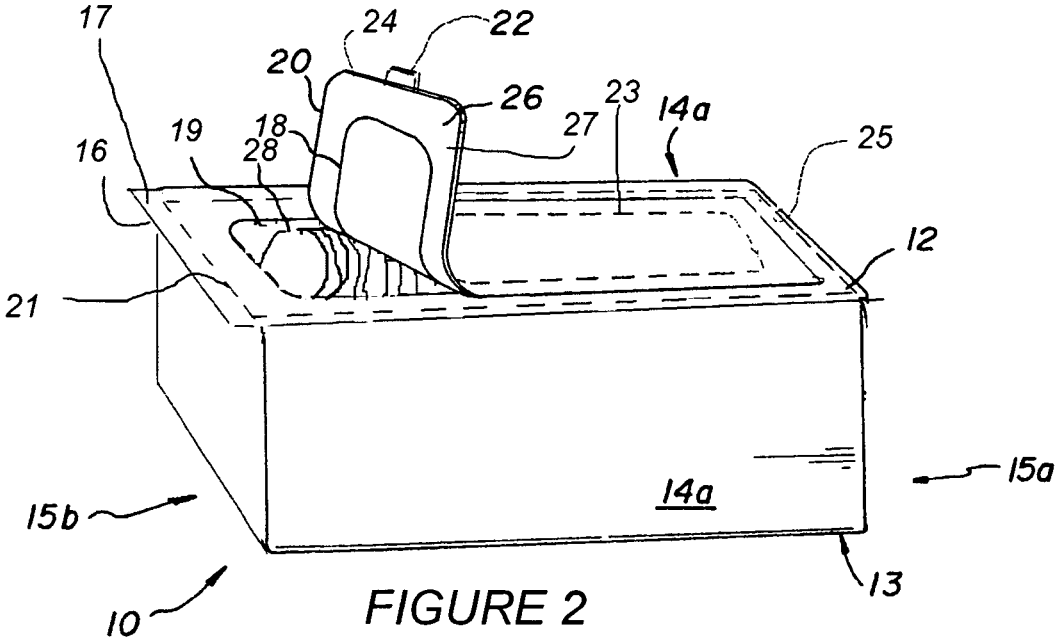
FIG. 2 is a perspective view of the container of FIG. 1 in a partially opened condition.
Figure 3:
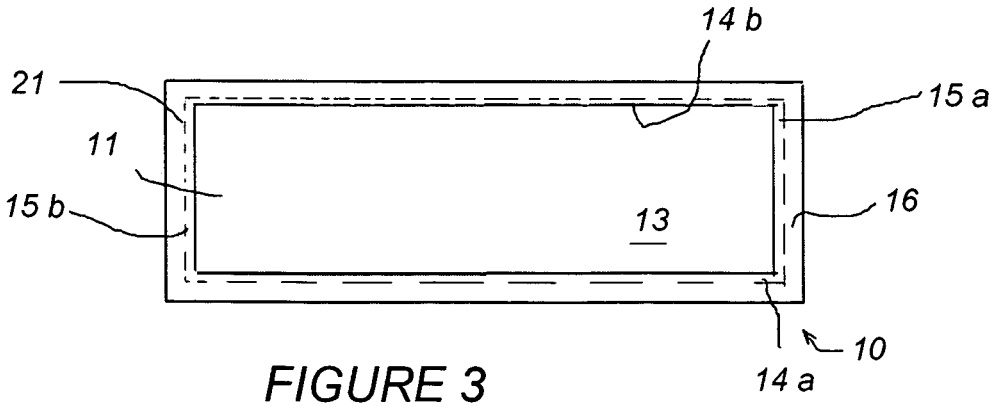
FIG. 3 is a top plan view of the container of FIG. 1 with the sealing layer removed.

Referring to FIGS. 1-3, resealable container 10 includes tray 11 which forms bottom 13 and opposing sides 14*a* and 14*b* and opposing ends 15*a* and 15*b*. A flange 16 extends outwardly from the exterior surface of the opposing sides 14*a*, 14*b* and 15*a*, 15*b*. Tray 11 is preferably manufactured as a thermoformed tray. Alternatively, any other appropriate manufacturing process and materials can be used to form a tray which is suitable for use in accordance with the present invention.

Film 17 is affixed to flange 16. Film 17 may be composed of a flexible material, semi-rigid material or a rigid material. A broken line 21 indicates the exterior surface of the respective sides 14*a*, 14,*b*, 15*a*, 15*b* from which the flange 16 extends which is covered by film 17.

Alternatively, tray 11 may not include flange 16, in which case, film 17 is affixed to the end surface of sides 14*a*, 14*b*, 15*a*, 15*b*, opposite bottom 13 where the sides 14, 15 are sufficiently thick to allow the film 17 to be affixed to end surfaces thereof. In another alternative embodiment, the flange may extend inwardly toward the center of the container rather than outwardly as depicted in container 10.

A flap 18 is cut in the film 17 as indicated by broken line 23. As depicted in FIGS. 1 and 2, flap 18 is cut completely around its perimeter on all sides. Alternatively, the flap may only be cut on part of its perimeter, such as three sides, leaving the fourth side attached to the film 17. When flap 18 is pulled back from the container 10, it forms opening 19.

A sealing layer in the form of a sealing label 20 is affixed to the flap 18. Advantageously, the sealing label 20 is permanently affixed to the flap 18 using an appropriate, first adhesive. The sealing label 20 covers a substantial portion of the top formed by film 17, extending from the proximity of end 15*a* to the proximity of end 15*b* and from the proximity of side 14*a* to the proximity of side 14*b*. The sealing area of label 20, i.e., the portion of sealing label 20 which is resealably affixed to top 12, terminates prior to any side 14*a*, 14*b*, 15*a*, 15*b* of container 10. Thus, the sealing area does not abut or extend completely to any end surface or flange of any side of container 10.

The size of the opening 19 and hence the size of flap 18 is at least around 30% of the surface area of film 17 and advantageously at least 50% the surface area of film 17 so as to more easily gain access to the food contents contained within container 10.

The surface area of sealing label 20 is advantageously proportional to the size of opening 19. Advantageously, the surface area of the sealing label should be approximately 1.3 to 2 times and more preferably around 1.8 times the size of opening 19. Further, it is advantageous to have the size of opening 19 be proportional to the size of container 10 and food products.

Graphics may be formed on the sealing label 20 which align with corresponding graphics on top 12 when the sealing label 20 is sealed or otherwise in a flap position on top 12. Alternatively, sealing label 20 may be transparent, allowing the graphics of top 12 to be visible through the sealing label 20.

A starter portion, for example a tab 22, extends from sealing label end 24. As a result, tab 22 can be grasped by one's fingers and thumb such that the tab 22 is easily accessible for one to pull. Further, the tab 22 facilitates closing of the container. The side of tab 22 and its shape are optimized for functionality. Advantageously, the tab 22 has a surface area of 1% to 6% that of the total surface area of sealing label 20.

Adhesive 26 is applied to sealing area 27 which is in contact with top 12 along a perimeter of flap 18. Advantageously, the second adhesive 26 provides a removable seal between the sealing label 20 and the top 12. As the first adhesive permanently affixes the sealing label 20 to the flap 18 and the second adhesive 26 provides a removable seal, the strength of the first adhesive is greater or stronger than the second adhesive. Adhesive 26 is not applied to tab portion 22. Alternatively, if adhesive is applied to the back surface of tab portion 22, i.e., the surface adjacent the sealing area 27, a deadening agent, either chemical or a layer is applied thereto, to prevent the tab portion 22 from adhering to the top 12.

The absence of an adhesive on tab 22 or the application of a deadening agent to the back surface of tab 22 allows a consumer to more easily grasp the starter portion in order to open the container 10 since tab 22 will not be adhered to the top 12. In addition, by giving a consumer a specific portion of the sealing cover to pull, the consumer is not drawn to touching the adhesive portion of the sealing label 20. Such touching could cause the sealing layer to lose its adhesiveness and thus not provide a proper reseal against the top 12 of the container 10. This could, in turn, allow air to gain access to the interior of the container 10 and the food product contained therein.

Container 10 is transformed from a closed condition shown in FIG. 1 to a partially opened condition depicted in FIG. 2 by grasping the tab 22 between one's finger and thumb and pulling back on the sealing layer 20 to gain access to opening 19. Once container 10 is opened, one can remove food product 28 such as cookies inside the food container through opening 19. Although the food product 28 is depicted as cookies, the food product 28 can be virtually any food item which includes but is not limited to discrete food items such as cookies, peanuts, cubed or shredded cheese, or other snack items; sliced food items such as sliced deli meats or sliced cheese; solid food items such as a brick of cheese and semi-solid food items such as food spreads, cream cheese, chocolate dipping sauce and pudding.

Figure 4:
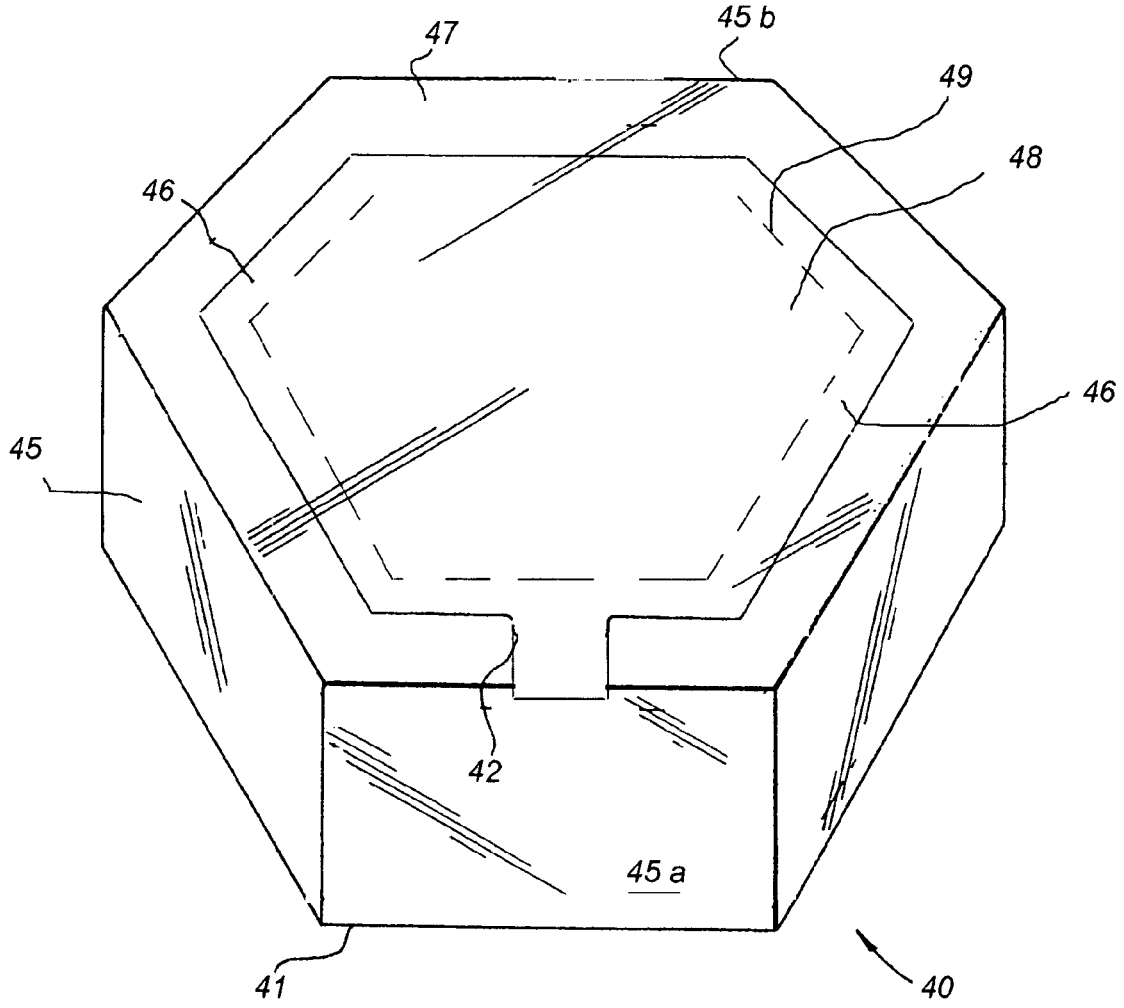
FIG. 4 is a perspective view of a different polygonal-shaped resealable food container.

In an alternative form of the present invention, container 40 has a hexagonal shape formed by tray 41 depicted in FIG. 4. Aspects of the functionality of the opening of container 40 are identical to those of container 10 except for those distinctions described herein. Film 47 is affixed to the top ends of sides 45 which unlike container 10 does not include an extending flange. The sides 45 are sufficiently thick to allow the film 47 to be affixed to end surfaces thereof. Flap 48 is die cut into film 47 on five sides leaving a sixth side 45*b* uncut as indicated by broken line 49, thereby permanently attaching flap 46 to film 47 on that sixth side 45*b*. Tab 42 extends from side 45*a* which advantageously allows one to easily grasp the tab 44. Like tab 22, there is no adhesive on the bottom surface of tab 44 so that tab 44 is not sealed to film 47. Further, although tab 42 extends past side 45*a*, the sealing area of sealing label 46 does not extend all the way to sides 45. Pulling back on tab 42 allows one to remove sealing layer 46 affixed to flap 48 to gain access to the contents of container 40.

Figure 5:
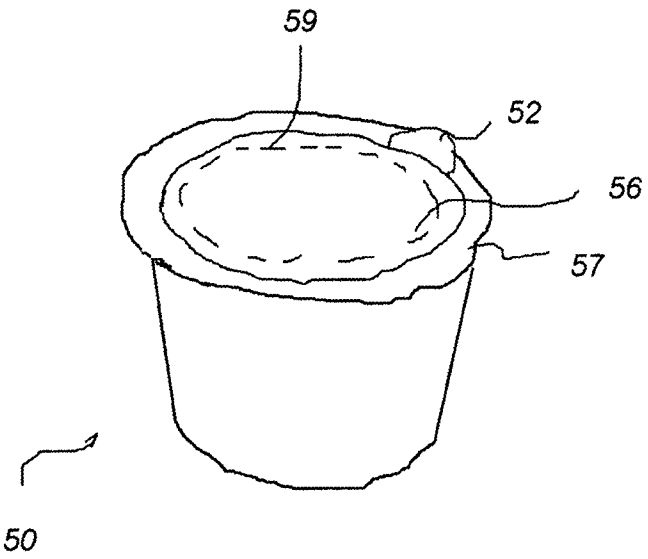
FIG. 5 is a perspective view of a generally cylindrically-shaped resealable food container.
Figure 6:
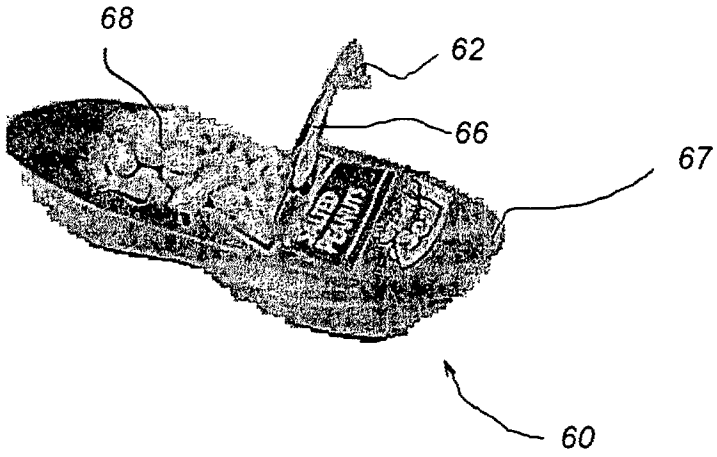
FIG. 6 is a perspective view of a contour-shaped resealable food container.

In an alternative embodiment, FIG. 5 depicts a generally cylindrical container 50 with circular sealing label 56 with tab 52 sealed to film 57. The access opening and flap are shown by broken line 59. FIG. 6 depicts yet another shaped container 60 having a contoured half peanut-shaped form for holding food product 68 such as peanuts. In the embodiments of FIGS. 5 and 6, as in the embodiments of FIGS. 1-4, one gains access to the contents of containers 50, 60 by pulling back on tabs 52, 62 of sealing labels 56, 66, respectively, and reseals container 50 by returning sealing label 56, 66 to its original position over the film 57, 67. If necessary, one can apply pressure to sealing label 56, 66, when relocated over film 57, 67 to ensure a sufficient seal is achieved therebetween.

Figure 7:
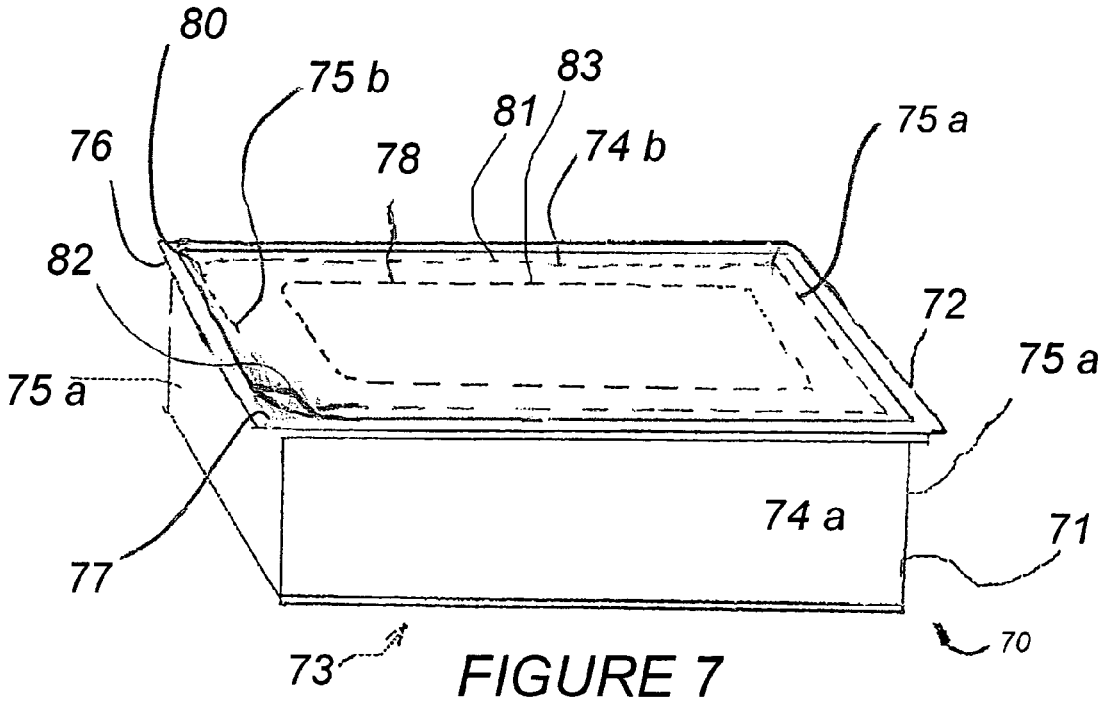
FIG. 7 is a perspective view of another resealable container in accordance with an additional embodiment the present invention, in a closed configuration.
Figure 8:
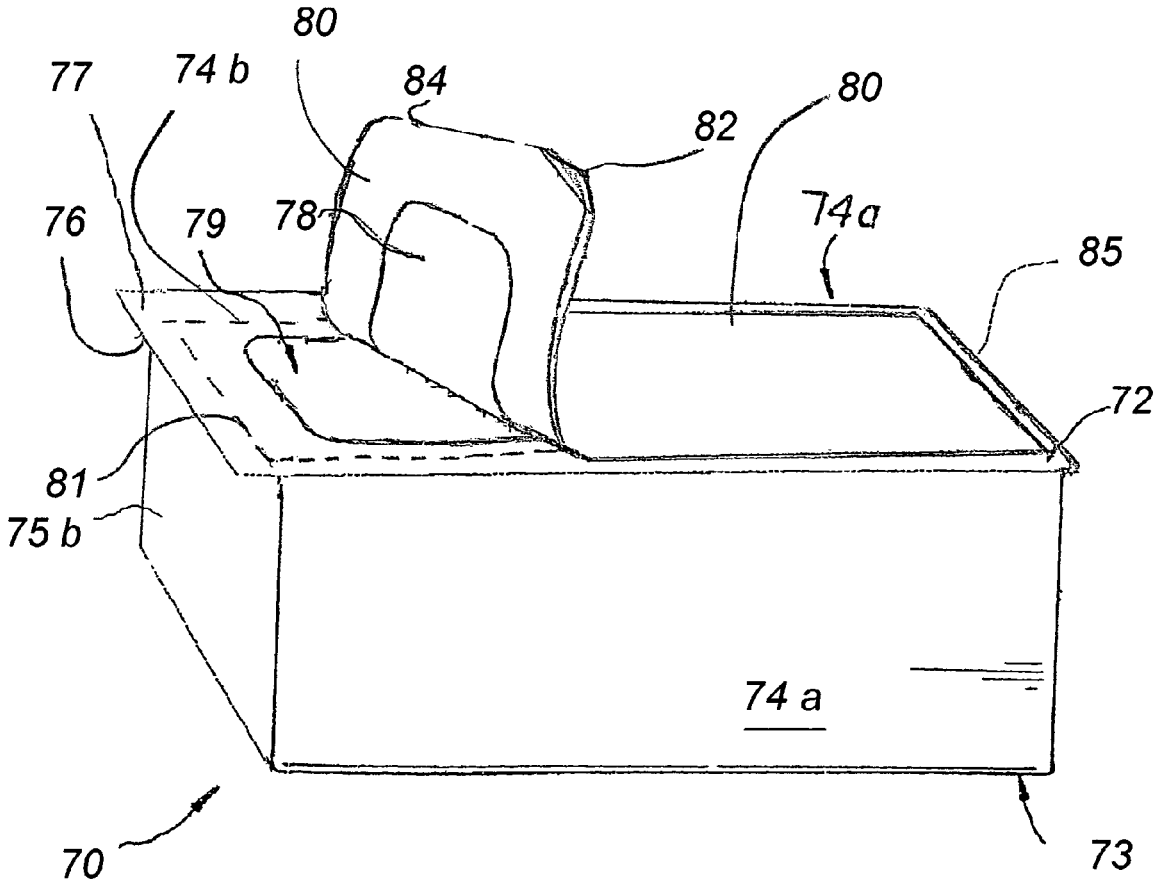
FIG. 8 is a perspective view of the container of FIG. 7 in a partially opened condition.

In an additional alternative embodiment, FIGS. 7 and 8 depict container 70 which is similar to container 10, where like elements have reference numbers increased by 60, but differs from container 10 in that sealing label 80 extends along film 77 to overlap a portion of film 77 affixed to flange 76, along the entire perimeter of top 72. Broken line 81 is used in FIGS. 7 and 8 to delineate the sides 74, 75 covered by both film 77 and sealing label 80. Broken line 83 is used in FIG. 7 to depict the die cut forming flap 78. A tab 82 extends from a corner of the sealing area of sealing label 80. One gains access into the container 70 by pulling back on tab 82 of the sealing label 80, thereby exposing opening 79.

One advantage of having the sealing label 80 overlapping the film 77 along a portion of the film 77 which is affixed to the flange 76 is that this configuration allows one to reseal the container 70 by pressing the flexible sealing label 80 along a more rigid flange material of the tray rather than an unsupported portion of the film.

The present invention offers numerous features and advantages over previous food containers. For example, in one form, the present invention includes a tab element which extends beyond a corner or edge of a top or side of the container which makes the tab easily accessible for being grasped and for withdrawing the sealing label from the container.

Another feature of the present invention is provided by a resealable sealing label which can be pulled back and resealed against a top portion of a flexible or rigid container.

Yet another feature of the present invention is provided by a sealing layer which extends over an opening in a container, but terminates prior to reaching any side of the container.

Although the invention has been described above in relation to preferred embodiments thereof, it will be understood by those skilled in the art that variations and modifications can be effected in these preferred embodiments without departing from the scope and spirit of the invention.

What is claimed:

1. A food container having a resealable closure comprising:

a film having a first side and a second side opposite the first side, the film forming a top of the food container, the top having a flap which can be pulled back to provide an access opening sufficiently large to provide hand access to substantially all of any discrete food articles contained within the food container, such that substantially any one of the discrete food articles can be accessed and removed individually through the access opening;

a sealing layer adhesively attached to the second side of the film, extending over the access opening and having a sealing area adhesively sealing said sealing layer along its entire perimeter to the second side of the film around said access opening, said sealing layer being releasable when said sealing layer is pulled to provide access to said access opening and resealable against the second side of the film to seal said access opening when said sealing layer is moved back against the top; and wherein said sealing layer is adhesively sealed to the flap with a first adhesive having a first adhesive strength and adhesively sealed in the sealing area with a second adhesive having a second adhesive strength, the first adhesive strength being greater than the second adhesive strength.

2. The container of claim 1, wherein the flap has substantially the same dimension as said access opening.

3. The container of claim 2, wherein said flap is permanently attached to said film on at least one end.

4. The container of claim 1, wherein said sealing layer comprises a starter portion located near a side of the top which can be grasped by a user.

5. The container of claim 4, wherein said starter portion comprises a tab.

6. The container of claim 5, wherein said tab extends from the sealing area of said sealing layer.

7. The container of claim 6, wherein said tab projects past an edge of said top of the container, said tab being accessible beyond the edge to be grasped.

8. The container of claim 1, wherein said film comprises a flexible material.

9. The container of claim 1, wherein said film comprises a semi-rigid material.

10. The container of claim 1, wherein said film comprises a rigid material.

11. The container of claim 1, wherein said top of the container includes graphics around said opening, and said sealing layer includes graphics which match the graphics on said top.

12. The container of claim 1, wherein said sealing layer is transparent.

13. The container of claim 1, wherein the access opening is around at least 30% of the surface area of said film.

14. The container of claim 1, wherein the food container further comprises a tray with sides having a top end surface wherein the film is affixed to the top end surface of the tray.

15. A food container comprising:

a tray having a bottom and at least one side, said side having a top end surface opposite the bottom;

a film having a first side and a second side opposite the first side, the first side affixed to the top end surface of the sides; said film forming a top over said tray; said top having a flap, which can be pulled back to provide an access opening to allow access to contents inside the food container;

a sealing layer adhesively attached to the second side of the film and having a sealing area adhesively sealing said sealing layer along its entire perimeter to the second side of the film around said access opening and said sealing layer extending along the second side of the film to overlap at least a portion of the film first side that is affixed to the top end surface of the at least one side of the tray, said sealing layer being releasable when said sealing layer is pulled in a direction away from said at least one side to in turn pull and thereby separate at least a portion of said sealing layer to provide access to said access opening and resealable against the second side of the film to seal said access opening when said sealing layer is moved back against the top; and wherein said sealing layer is adhesively sealed to the flap with a first adhesive having a first adhesive strength and adhesively sealed in the sealing area with a second adhesive having a second adhesive strength, the first adhesive strength being greater than the second adhesive strength.

16. The container of claim 15, wherein the flap has substantially the same dimension as said access opening.

17. The container of claim 16, wherein said flap is permanently attached to said film on at least one end.

18. The container of claim 15, wherein said sealing layer comprises a starter portion located at one end of said sealing layer which can be grasped by a user.

19. The container of claim 18, wherein said starter portion comprises a tab.

20. The container of claim 19, wherein said tab extends from the sealing area of said sealing layer.

21. The container of claim 20, wherein said tab extends from a corner of said sealing area of said sealing layer.

22. The container of claim 21, wherein said tab projects past a corner of said top at one side of the container, said tab being accessible beyond the edge to be grasped.

23. The container of claim 15, wherein said film comprises a flexible material.

24. The container of claim 15, wherein said film comprises a semi-rigid material.

25. The container of claim 15, wherein said film comprises a rigid material.

26. The container of claim 15, wherein said tray comprises a semi-rigid material.

27. The container of claim 15, wherein said tray comprises a rigid material.

28. The container of claim 15, wherein said tray has a cylindrical shape and said at least one side comprises a single side.

29. The container of claim 15, wherein said tray has a polygonal shape, the at least one side comprises a number of sides corresponding to the polygonal shape of the tray; and said film is affixed to the top end surfaces of all sides of the polygonal container.

30. The container of claim 29, wherein said sealing layer overlaps at least a portion of said film along all of the sides where said film is affixed to each of the respective top end surfaces of the polygonal container.

31. The container of claim 15, wherein said top end surface of said at least one side comprises a flange upon which said film is affixed.

32. The container of claim 31, wherein said tray has a cylindrical shape, said at least one side comprises a single side, and said film is affixed to the flange of the single side.

33. The container of claim 32, wherein said sealing layer overlaps at least a portion of said film where said film is affixed to the flange.

34. The container of claim 31, wherein said tray has a polygonal shape, the at least one side comprises a number of sides corresponding to the polygonal shape; and said film is affixed to respective flanges of all of the sides of the polygonal shaped container.

35. The container of claim 34, wherein said sealing layer overlaps at least a portion of said film along all flanges where said film is affixed thereto.

36. The container of claim 15, wherein said tray has a rectangular shape.

37. The container of claim 15, further comprising a food product disposed in said tray.

38. The container of claim 37, wherein said food product comprises discrete food items.

39. The container of claim 37, wherein said food product comprises cheese.

40. The container of claim 37, wherein said food product comprises bacon.

* * * * *